US007456590B2

(12) United States Patent
Takeda et al.

(10) Patent No.: US 7,456,590 B2
(45) Date of Patent: Nov. 25, 2008

(54) VEHICULAR LAMP

(75) Inventors: Hitoshi Takeda, Shizuoka-ken (JP); Masayasu Ito, Shizuoka-ken (JP)

(73) Assignee: Koito Manufacturing Co., Ltd, Tokyo (JP)

( * ) Notice: Subject to any disclaimer, the term of this patent is extended or adjusted under 35 U.S.C. 154(b) by 743 days.

(21) Appl. No.: 10/832,074

(22) Filed: Apr. 26, 2004

(65) Prior Publication Data

US 2004/0217712 A1 Nov. 4, 2004

(30) Foreign Application Priority Data

May 1, 2003 (JP) ..... 2003-126439

(51) Int. Cl.
*H05B 37/02* (2006.01)

(52) U.S. Cl. ..... 315/360; 307/10.8; 315/77

(58) Field of Classification Search ..... 315/209 R, 315/216, 291, 303, 312, 224, 247, 307
See application file for complete search history.

(56) References Cited

U.S. PATENT DOCUMENTS 4,529,949 A 7/1985 de Wit et al.
4,570,108 A * 2/1986 Stroede et al. ..... 315/360
5,438,499 A * 8/1995 Bonte et al. ..... 363/21.16
5,666,028 A * 9/1997 Bechtel et al. ..... 315/82
6,798,152 B2 * 9/2004 Rooke et al. ..... 315/209 R
6,847,169 B2 * 1/2005 Ito et al. ..... 315/77
6,867,557 B2 * 3/2005 Ito et al. ..... 315/307

FOREIGN PATENT DOCUMENTS

JP S58-151075 9/1983
JP H4-100748 4/1992
JP 2002-231014 8/2002

OTHER PUBLICATIONS

Patent Abstracts of Japan; Publication No. 2002-231014 dated Aug. 16, 2002 (1pg.).
Japanese Office Action for Japanese Patent Application No. 2003-126439, Dated Mar. 25, 2008, and English translation thereof, 4 pages.

* cited by examiner

*Primary Examiner*—Douglas W. Owens
*Assistant Examiner*—Jimmy T Vu
(74) *Attorney, Agent, or Firm*—Osha · Liang LLP

(57) ABSTRACT

A vehicular lamp used in an automobile includes: semiconductor light emitting elements for emitting light; a time measurement unit for measuring time in which the semiconductor light emitting elements continues to emit light; and a current supplying unit for supplying a supply current that increases as the time measured by the time measurement unit increases, to the semiconductor light emitting elements.

5 Claims, 13 Drawing Sheets

VEHICULAR LAMP

This patent application claims priority from a Japanese patent application No. 2003-126439 filed on May 1, 2003, the contents of which are incorporated herein by reference.

BACKGROUND OF THE INVENTION

1. Field of the Invention

The present invention relates to a vehicular lamp. More particularly, the invention relates to a vehicular lamp using semiconductor light emitting elements as a light source.

2. Description of the Related Art

A conventional vehicular lamp using semiconductor light emitting elements has been known as disclosed, for example, in a Japanese Patent Application Laid-Open No. 2002-231014. Exemplary applications of such a vehicular lamp include a high mounted stop lamp, a tail lamp, a stop lamp that are provided for preventing rear-end collision, and the like.

However, the light amount of the semiconductor light emitting elements may decrease in a case where the temperature increases. Thus, the vehicular lamp using the semiconductor light emitting elements requires the necessary light amount to be ensured for safety reasons even when the temperature increases.

SUMMARY OF THE INVENTION

Therefore, it is an object of the present invention to provide a vehicular lamp, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a vehicular lamp used in an automobile, comprises: semiconductor light emitting elements operable to emit light; a time measurement unit operable to measure time in which the semiconductor light emitting elements continues to emit light; and a current supplying unit operable to supply a supply current that increases as the time measured by the time measurement unit increases, to the semiconductor light emitting elements.

The time measurement unit may include a capacitor that is charged with a time constant substantially equal to a time constant of increase in a temperature of the semiconductor light emitting elements in a case where the semiconductor light emitting elements emits light, and the current supplying unit may output the supply current that increases as the time measured by the time measurement unit increases by outputting the supply current that increases as a charged voltage of the capacitor rises.

The capacitor may be discharged with a time constant substantially equal to a time constant of decrease in the temperature of the semiconductor light emitting elements in a case where the semiconductor light emitting elements emits no light, and the current supplying unit may output the supply current that decreases as the charged voltages drops.

The vehicular lamp may further comprise a voltage limiting unit operable to limit the charged voltage to have a predetermined upper limit that is lower than a power-supply voltage externally supplied to the vehicular lamp, to make the time constant of the temperature increase of the semiconductor light emitting elements substantially equal to the time constant of charging of the capacitor in a case where the semiconductor light emitting elements emits light.

The time measurement unit may include a counter operable to count pulse signals having a predetermined period in a case where the semiconductor light emitting elements emits light and to decrease a counted value one by one based on the pulse signals in a case where the semiconductor light emitting elements emits no light, and the current supplying unit may output the supply current based on the counted value of the counter.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
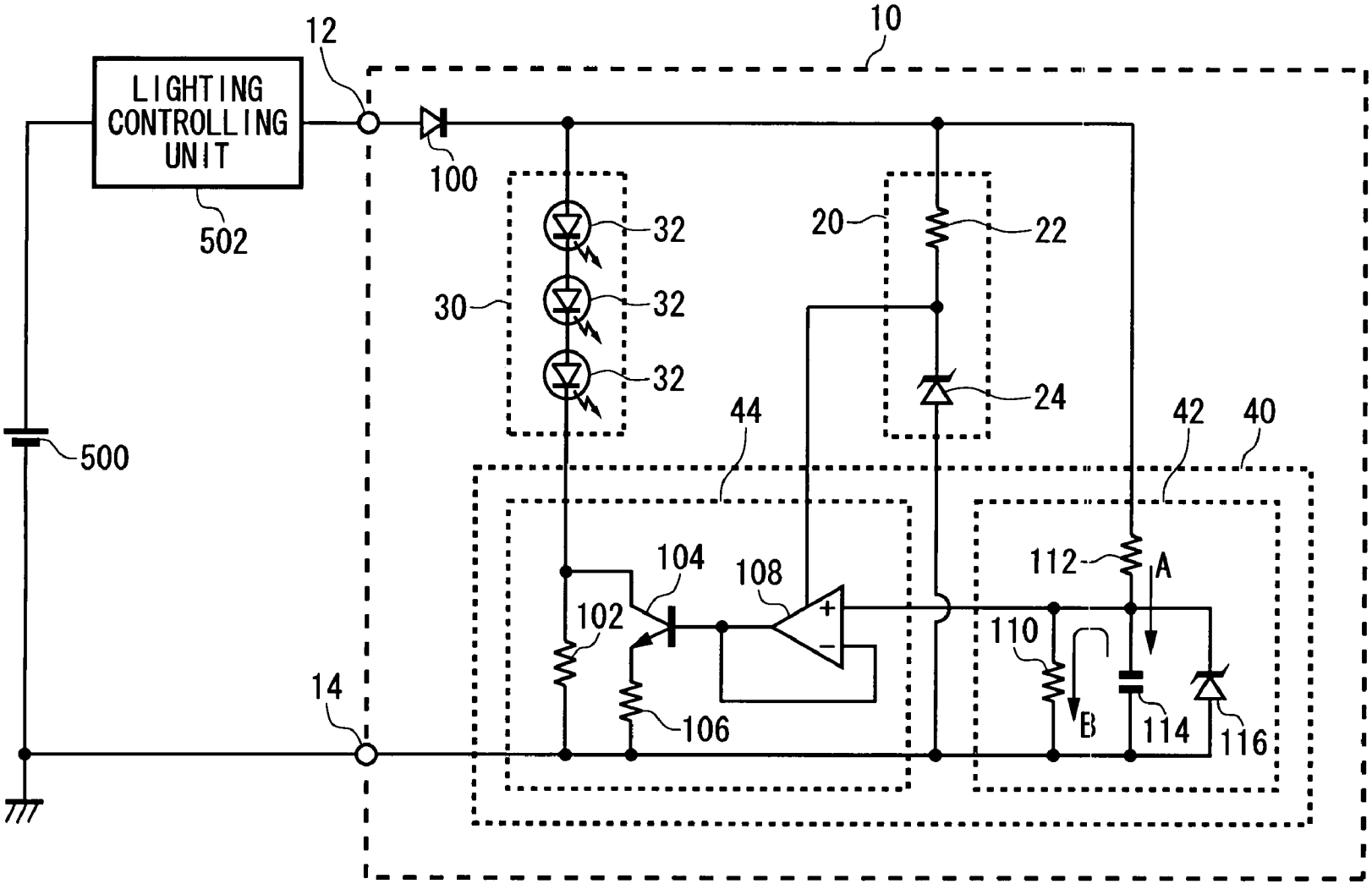
FIG. 1 illustrates an exemplary structure of a vehicular lamp according to an embodiment of the present invention.

FIG. 1 illustrates an exemplary structure of a vehicular lamp 10 according to an embodiment of the present invention, together with a power supply 500 and a lighting controlling unit 502. The vehicular lamp 10 of the present embodiment is provided on a body of an automobile or the like, as a stop lamp. The vehicular lamp 10 may be used as a tail lamp, ahead lamp or the like. The vehicular lamp 10 of the present embodiment can suppress change of the light amount of semiconductor light emitting elements 32 included in the vehicular lamp 10 caused by a temperature change of the semiconductor light emitting elements 32.

The power supply 500 is a battery of the automobile, for example, and supplies a DC power to the vehicular lamp 10 via the lighting controlling unit 502. In a case where a brake pedal of the automobile has been pressed down, for example, the lighting controlling unit 502 supplies the DC power from the power supply 500 to the vehicular lamp 10. The vehicular lamp 10 receives a positive voltage from the lighting controlling unit 502 at a terminal 12 and is grounded at a terminal 14.

The vehicular lamp 10 includes a diode 100 for protection against reverse connection, a voltage clamping unit 20, a light source array 30 and a current controlling unit 40. The diode 100 protects the vehicular lamp 10 against reverse connection of the power supply and the like.

The light source 30 includes a plurality of semiconductor light emitting elements 32. Each semiconductor light emitting elements 32 emits light when a power is supplied to the vehicular lamp 10. An upstream end of the light source array 30 in a current direction is connected to the terminal 12 via the diode 100, while a downstream end is connected to the current controlling unit 40. In this example, the semiconductor light emitting elements 32 is a light emitting diode that generates light by a power supplied thereto. Moreover, in this example, the light source array 30 includes a plurality of semiconductor light emitting elements 32 connected in series in forward direction. Alternatively, the light source array 30 may include a single semiconductor light emitting elements 32. The vehicular lamp 10 may include a plurality of light source 30 connected in parallel.

The current controlling unit 40 includes a time measurement unit 42 and a current supplying unit 44. The time measurement unit 42 includes a capacitor 114, a resistor 110, a resistor 112 and a Zener diode 116. One end of the capacitor 114 is connected to the terminal 12 via the resistor 112 and the diode 100 for protection against reverse connection, and is also grounded via the resistor 110. The other end of the capacitor 114 is grounded.

Thus, while the power is supplied to the vehicular lamp 10 and the semiconductor light emitting elements 32 are on, a current flows in a direction shown with arrow A and therefore the capacitor 114 is charged. In this case, as a certain time has passed after turning on the semiconductor light emitting elements 32, the charged voltage of the capacitor 114 rises. In this manner, the capacitor 114 measures the length of the time during which the semiconductor light emitting elements 32 continue to emit light. On the other hand, while no power is supplied to the vehicular lamp 10, the semiconductor light emitting elements 32 are off and electric charges stored in the capacitor 114 flow in a direction shown with arrow B, thereby the capacitor 114 is discharged. The Zener diode 116 is connected to the capacitor 114 in parallel and limits the upper limit of the charged voltage of the capacitor 114 to a Zener voltage of the Zener diode 116.

The current supplying unit 44 includes a resistor 102, an NPN transistor 104, a resistor 106 and an operational amplifier 108. The resistor 102 grounds the downstream end of the light source array 30 in the current direction. In this case, the resistor 102 allows at least a part of a supply current flowing through the light source array 30 to flow therethrough. Thus, when the power is supplied to the vehicular lamp 10, the semiconductor light emitting elements 32 are turned on.

The operational amplifier 108 is a voltage follower, and supplies the charged voltage that it receives at its positive input terminal from the capacitor 114, to a base terminal of the NPN transistor 104. A collector terminal of the NPN transistor 104 is connected to the downstream end of the light source array 30 in the current direction, while an emitter terminal is grounded via the resistor 106. Thus, when the charged voltage of the capacitor 114 has increased, a base voltage of the NPN transistor 104 also increases and therefore the NPN transistor 104 is turned on so as to sink a collector current received from the light source array 30. As a result, the NPN transistor 104 increases the supply current flowing through the light source array 30. In this manner, the current supplying unit 44 supplies the supply current to the light source array 30, which increases when the charged voltage increases and decreases when the charged voltage decreases.

The capacitor 114 is charged to have the charged voltage that increases during a time period in which the semiconductor light emitting elements 32 is on. Therefore, in a case where the vehicular lamp 10 continues to be on for a predetermined time or more, the current supplying unit 44 increases the supply current. On the other hand, while the semiconductor light emitting elements 32 is off, the resistor 110 decreases the charged voltage. Thus, in a case where the vehicular lamp 10 is turned on after it was turned off, the current supplying unit 44 decreases the supply current in accordance with the decrease of the charged voltage. Please note that the current supplying unit 44 may supply a constant supply current that is determined in accordance with the output of the current controlling unit 40, to the light source array 30. The current supplying unit 44 may include a DC-DC converter that outputs a DC current in accordance with the output of the current controlling unit 40.

The voltage clamping unit 20 includes a resistor 22 and a Zener diode 24 connected in series, and clamps a positive voltage that it receives via the terminal 12 with a Zener voltage of the Zener diode 24 so as to output the clamped voltage. The voltage clamping unit 20 supplies a power-supply voltage to the operational amplifier 108. Thus, in a case where the vehicular lamp 10 receives a dump surge voltage, the voltage clamping unit 20 protects the operational amplifier 108.

The time measurement unit 42 is described in more detail, below. In this example, in a case where the power is supplied to the vehicular lamp 10 and the semiconductor light emitting elements 32 are on, the capacitor 114 is charged with a time constant defined by electric resistance of the resistor 102 and capacitance of the capacitor 114. The electric resistance of the resistor 112 and the capacitance of the capacitor 114 are selected in such a manner that a time constant of the increase of the charged voltage of the capacitor 114 increases is substantially equal to a time constant of the temperature increase of the semiconductor light emitting elements 32*s* while it is on. Therefore, the capacitor 114 is charged with the time constant substantially equal to the time constant of the temperature increase of the semiconductor light emitting elements 32 in a case where the semiconductor light emitting elements 32 emits light. In this case, the current supplying unit 44 outputs the supply current that increases in accordance with the increase of the charged voltage of the capacitor 114. Thus, with the temperature increase of the semiconductor light emitting elements 32, the current supplying unit 44 increases the supply current flowing through the semiconductor light emitting elements 32.

In some cases, the light amount of the semiconductor light emitting elements 32 formed by a light emitting diode may decrease when the temperature thereof has increased. However, in this example, the supply current is increased as the temperature increases. Therefore, the decrease of the light amount of the semiconductor light emitting elements 32 caused by the temperature increase can be prevented, so that light beams can be made as flat as possible. In a case where the supply current that increases with the temperature increase is allowed to flow, it is preferable that the current supplying unit 44 output the supply current that corresponds to 60-70% of the maximum rating current of the semiconductor light emitting elements 32.

The Zener diode 116 limits the charged voltage of the capacitor 114 to have an upper limit that is lower than the power-supply voltage externally supplied to the vehicular lamp 10 and is determined by the Zener voltage of the Zener diode 116. In this case, by keeping the charged voltage after a predetermined time has passed to be the upper limit, for example, the time constant of the increase of the charged voltage of the capacitor 114 and the time constant of the temperature increase of the semiconductor light emitting elements 32 while it is on can be designed to be substantially equal. Thus, in a case where the semiconductor light emitting elements 32 emits light, it is possible to easily make the time constant of the temperature increase of the semiconductor light emitting elements 32 coincident with the time constant of the charging of the capacitor 114. Moreover, since the Zener diode 116 limits the charged voltage, the current supplying unit 44 can limit the supply current flowing through the semiconductor light emitting elements 32 to 60-70% of the maximum rating current. It should be noted that the Zener diode 116 is an exemplary voltage limiting unit.

In a case where no power is supplied to the vehicular lamp 10, each semiconductor light emitting elements 32 is off and discharges heat gradually. In this case, the charged voltage of the capacitor 114 is discharged with a time constant substantially equal to a time constant of the temperature decrease of the semiconductor light emitting elements 32 via the resistor 110. The electric resistance of the resistor 110 and the capacitance of the capacitor 114 are selected in such a manner that the time constant of the decrease of the charged voltage of the capacitor 114 and the time constant of the temperature decrease of the semiconductor light emitting elements 32 is substantially equal. Therefore, in a case where the semiconductor light emitting elements 32 emits no light, the capacitor 114 is discharged with the time constant substantially equal to the time constant of the temperature decrease of the semiconductor light emitting elements 32. Thus, in a case where the vehicular lamp 10 is turned on after it was turned off, the current supplying unit 44 outputs the supply current that decreases with the decrease of the charged voltage. Therefore, when a time period in which the vehicular lamp 10 is off is short, the vehicular lamp 10 turns on the semiconductor light emitting elements 32 again from a state in which the supply current was sort of increased. Accordingly, the vehicular lamp 10 can suppress the change of the light amount of the semiconductor light emitting elements 32 caused by the temperature change of the semiconductor light emitting elements 32.

Figure 2:
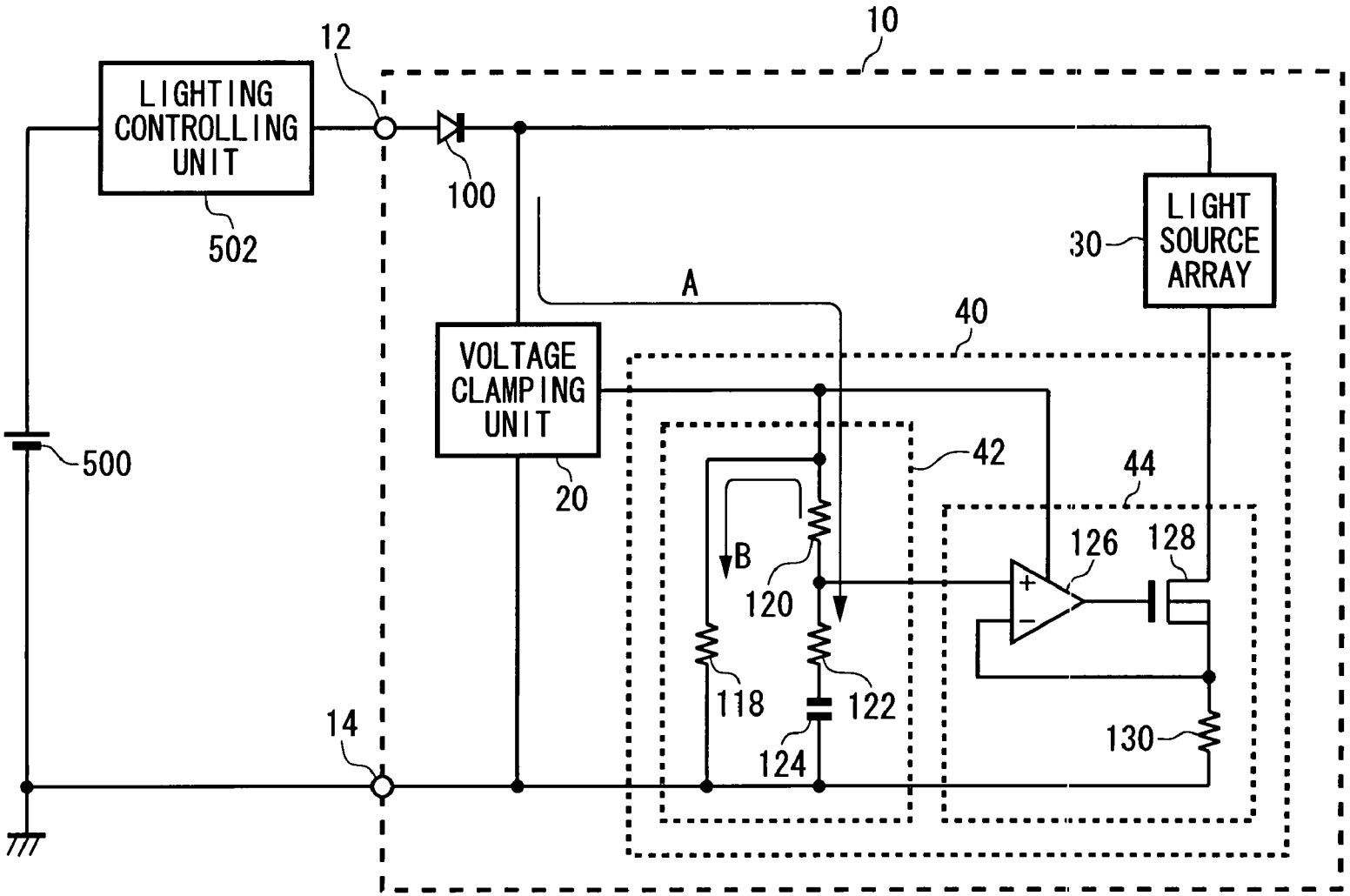
FIG. 2 illustrates another exemplary structure of the vehicular lamp.

FIG. 2 illustrates another exemplary structure of the vehicular lamp 10. The components in this example, that are the same as those in FIG. 1, are labeled with the same reference numerals as those in FIG. 1 and the description is omitted except for the following. The vehicular lamp 10 includes the diode 100 for protection against reverse connection, the voltage clamping unit 20, the light source array 30 and the current controlling unit 40. The current controlling unit 40 includes the time measurement unit 42 and the current supplying unit 44.

The time measurement unit 42 includes a resistor 118, a resistor 120, a resistor 122 and a capacitor 124. One end of the capacitor 124 is grounded, while the other end is connected to the voltage clamping unit 20 via the resistors 122 and 120. One end of the resistor 118 is grounded, while the other end is connected to the voltage clamping unit 20.

Thus, when a power is supplied to the vehicular lamp 10, a current flows in a direction shown with arrow A and the capacitor 124 is charged with a time constant defined by electric resistance of the resistors 120 and 122 and capacitance of the capacitor 124. The capacitor 124 supplies the charged voltage to the current supplying unit 44 via the resistance 122. In this manner, the time measurement unit 42 outputs the charged voltage that depends on the length of time in which the power is supplied to the vehicular lamp 10. On the other hand, when no power is supplied to the vehicular lamp 10, electric charges stored in the capacitor 124 flow in a direction shown with arrow B, and the capacitor 124 is discharged with a time constant defined by electric resistance of the resistors 118, 120 and 122 and the capacitance of the capacitor 124.

The current supplying unit 44 includes an operational amplifier 126, an NMOS transistor 128 and a resistor 130. The NMOS transistor 128 and the resistor 130 are connected to the downstream end of the light source array 30 in the current direction, in series. The NMOS transistor 128 allows a current in accordance with an output voltage of the operational amplifier 126 that the NMOS transistor 128 receives at its gate terminal, to flow through the light source array 30. The resistor 130 outputs a detection voltage in accordance with the current flowing through the light source array 30. The operational amplifier 126 receives the charged voltage at its positive input terminal via the resistor 122 as a reference voltage, and receives the detection voltage generated by the resistor 130 at its negative input terminal. In this case, the NMOS transistor 128 causes a current to flow in the light source array 30 in accordance with the output of the operational amplifier 126, in such a manner that the reference voltage and the detection voltage are substantially equal to each other. Thus, when the reference voltage rises, the current supplying unit 44 increases the supply current flowing through the light source array 30.

When a power is supplied to the vehicular lamp 10, the light source 30 is turned on and the capacitor 124 is charged to have the charged voltage in accordance with the time period in which the light source 30 is on. The time constant of charging the capacitor 124 is substantially equal to the time constant of the temperature increase of the semiconductor light emitting elements 32 that is on. Thus, the time measurement unit 42 outputs the charged voltage in accordance with the temperature increase of the semiconductor light emitting elements 32 that is on. In this manner, the current supplying unit 44 increases the supply current flowing through the light source 30 in accordance with the temperature increase. Accordingly, the vehicular lamp 10 can prevent the decrease of the light amount of the semiconductor light emitting elements 32 with the temperature increase of the semiconductor light emitting elements 32.

When no power is supplied to the vehicular lamp 10, the semiconductor light emitting elements 32 is turned off. In this case, the capacitor 124 is discharged in accordance with the time period in which the light source 30 is off, thereby decreasing its charged voltage. The time constant of discharge of the capacitor 124 is substantially equal to the time constant of the temperature decrease of the semiconductor light emitting elements 32 that is off. Thus, the time measurement unit 42 outputs the charged voltage in accordance with the temperature decrease of the semiconductor light emitting elements 32 that is off. In this manner, the current supplying unit 44 decreases the supply current flowing through the light source array 30 in accordance with the temperature decrease, in a case where the vehicular lamp 10 is turned on after it was turned off. Accordingly, the vehicular lamp 10 can suppress the change of the light amount of the semiconductor light emitting elements 32 caused by the temperature change of the semiconductor light emitting elements 32.

In an alternative example, the operational amplifier 126 may control the NMOS transistor 128 based on the detection voltage changed based on the charged voltage and a constant reference voltage, for example. In this case, the vehicular lamp 10 can also suppress the change of the light amount of the semiconductor light emitting elements 32 caused by the temperature change of the semiconductor light emitting elements 32.

Figure 3:
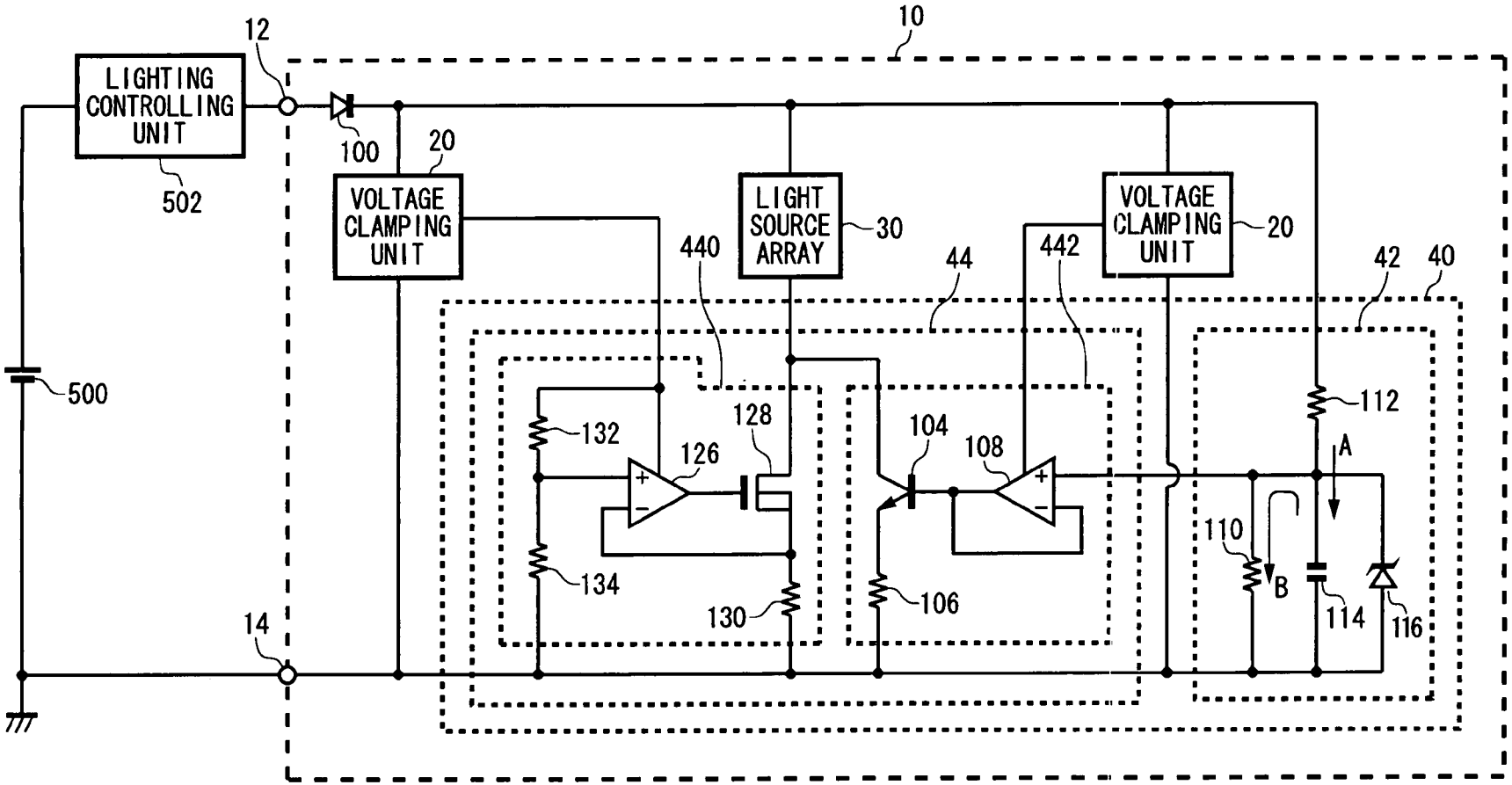
FIG. 3 illustrates still another exemplary structure of the vehicular lamp.

FIG. 3 illustrates still another exemplary structure of the vehicular lamp 10. The components in this example, that are the same as those in FIG. 1 or 2, are labeled with the same reference numerals as those in FIG. 1 or 2 and the description thereof is omitted except for the following. The vehicular lamp 10 includes the diode 10 for protection against reverse connection, the light source 30, the current controlling unit 40 and a plurality of voltage clamping units 20.

The current controlling unit 40 includes the time measurement unit 42 and the current supplying unit 44. The time measurement unit 42 has the same or similar function and structure as/to those in FIG. 1. The current supplying unit 44 includes a constant current supplying unit 440 and a varying current supplying unit 442. The constant current supplying unit 440 has the same or similar function as/to the current supplying unit 44 in FIG. 2. The constant current supplying unit 440 receives the reference voltage at the positive input terminal of the operational amplifier 126 and causes a current in accordance with the received reference voltage to flow in the NMOS transistor 128. The operational amplifier 126 receives a constant voltage obtained by dividing the output of the voltage clamping unit 20 by the resistors 132 and 134, as the reference voltage. Thus, the constant current supplying unit 440 allows a constant current depending on the reference voltage to flow, as a part of the supply current flowing through the light source array 30 connected to the NMOS transistor 128 in series.

The varying current supplying unit 442 has the same or similar function and structure as/to the current supplying unit 44 in FIG. 1 and causes a current in accordance with the charged voltage received from the time measurement unit 42 to flow through the light source array 30. Thus, when the charged voltage has increased with the time in which the light source array 30 is on, the current supplying unit 44 increases the supply current to be supplied to the light source array 30. Therefore, in this example, the vehicular lamp 10 can also suppress the change of the light amount of the semiconductor light emitting elements 32 caused by the temperature change of the semiconductor light emitting elements 32.

Figure 4:
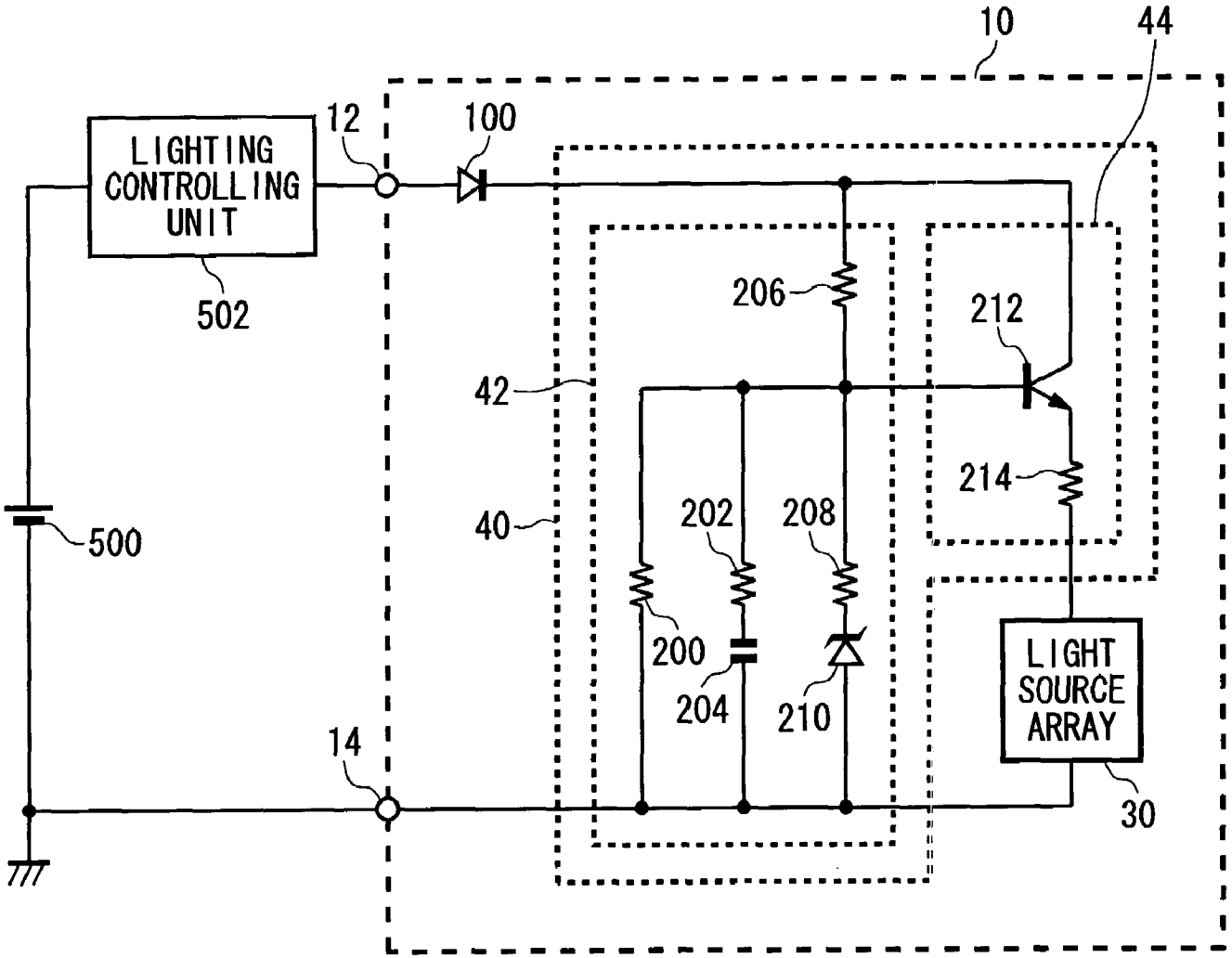
FIG. 4 illustrates still another exemplary structure of the vehicular lamp.

FIG. 4 illustrates still another exemplary structure of the vehicular lamp 10. The components in this example, that are the same as those in FIG. 1, are labeled with the same reference numerals as those in FIG. 1 and the description thereof is omitted except for the following. The vehicular lamp 10 includes the diode 100 for protection against reverse connection, the light source array 30, and the current controlling unit 40. The downstream end of the light source array 30 in the current direction is grounded, while the upstream end is connected to the current controlling unit 40.

The current controlling unit 40 includes the time measurement unit 42 and the current supplying unit 44. The time measurement unit 42 includes a plurality of resistors 200, 202, 206, 208, a capacitor 204 and a Zener diode 210. One end of the capacitor 204 is grounded, while the other end is connected to a cathode of the diode 100 via the resistors 202 and 206. An anode of the Zener diode 210 is grounded, while a cathode thereof is connected to the cathode of the diode 100 via the resistors 208 and 206. One end of the resistor 200 is grounded, while the other end is connected to the cathode of the diode 100 via the resistor 206.

When a power is supplied to the vehicular lamp 10, the capacitor 204 is charged with a time constant defined by electric resistance of the resistors 206 and 202 and capacitance of the capacitor 204, thereby generating the charged voltage. That time constant is substantially equal to a time constant of the temperature increase of the semiconductor light emitting elements 32 that is on. The capacitor 204 supplies that charged voltage to the current supplying unit 44 via the resistor 202. On the other hand, when no power is supplied to the vehicular lamp 10, the capacitor 204 is discharged with a time constant defined by electric resistance of the resistors 200 and 202 and the capacitance of the capacitor 204.

The current supplying unit 44 includes an NPN transistor 212 and a resistor 214. A collector terminal of the NPN transistor 212 is connected to the cathode of the diode 100, while an emitter terminal is connected to the light source array 30 via the resistor 214. A base terminal of the NPN transistor 212 receives the charged voltage from the time measurement unit 42 and causes a current having the magnitude in accordance with the charged voltage thus received to flow in the light source array 30. Thus, the current supplying unit 44 increases the supply current flowing through the light source array 30 with the temperature increase of the light source array 30 that is on. Therefore, in this example, the vehicular lamp 10 can also suppress the change of the light amount of the semiconductor light emitting elements 32 caused by the temperature change of the semiconductor light emitting elements 32.

Figure 5:
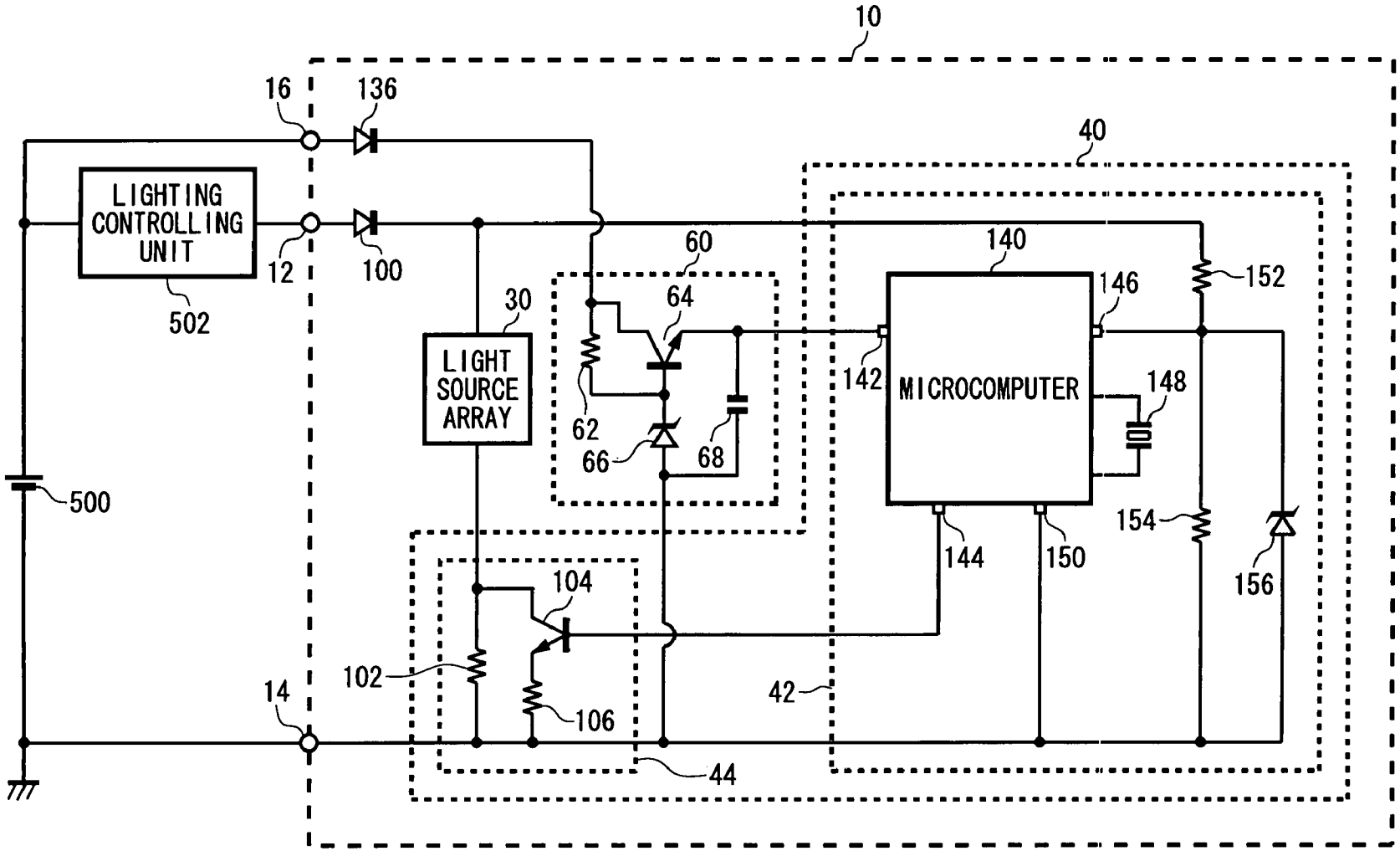
FIG. 5 illustrates still another exemplary structure of the vehicular lamp.

FIG. 5 illustrates still another exemplary structure of the vehicular lamp 10. The components in this example that are the same as those in FIG. 1 are labeled with the same reference numerals as those in FIG. 1, and the description thereof is omitted except for the following. The vehicular lamp 10 includes diodes for protection against reverse connection 100 and 136, a constant-voltage circuit 60, the light source array 30 and the current controlling unit 40.

The constant-voltage circuit 60 includes a resistor 62, an NPN transistor 64, a Zener diode 66 and a capacitor 68. The constant-voltage circuit 60 changes a voltage input via the diode 136 to be a Zener voltage of the Zener diode 66 that is constant and then supplies that Zener voltage to the current controlling unit 40 via the NPN transistor 64.

The current controlling unit 40 includes the current supplying unit 44 and the time measurement unit 42. The current supplying unit 44 includes the resistor 102, the NPN transistor 104 and the resistor 106. Except that the base terminal of the NPN transistor 104 is connected to the time measurement unit 42 without operational amplifier 108, the current supplying unit 44 in this example has the same or similar function and structure as/to the current supplying unit 44 in FIG. 1.

The time measurement unit 42 includes a microcomputer 140, a crystal oscillator 148, a plurality of resistors 152 and 154, and a Zener diode 156. The microcomputer 140 includes a power-supply terminal 142, an analog voltage output terminal 144, an input terminal 146 and an earth terminal 150. The power-supply terminal 142 receives a positive voltage from the constant-voltage circuit 60. The earth terminal 150 is grounded. The microcomputer 140 serves as a counter for counting pulse signals having a period that is based on a reference clock generated by the crystal oscillator 148. The microcomputer 140 outputs an analog voltage in accordance with the counted value from the analog voltage output terminal 144.

In this example, the microcomputer 140 stores correspondence between the counted values and voltages to be output from the analog voltage output terminal 144 in form of table, and refers to the table by using the counted value, thereby outputting the analog voltage. The microcomputer 140 may receive the reference clock from a ceramic oscillator or a resonator using a capacitor and a resistor, for example, in place of the crystal oscillator. For example, the microcomputer 140 may receive the reference clock from the outside of the vehicular lamp 10.

An anode of the Zener diode 156 is grounded, while a cathode is connected to the terminal 12 via the resistor 152 and the diode 100. The cathode of the Zener diode 156 is also grounded via the resistor 154. Moreover, the cathode of the Zener diode 156 is connected to the input terminal 146. Thus, the Zener diode 156 reduces the positive voltage received by the vehicular lamp 10 to a logical level to be supplied to the microcomputer 140 and supplies the reduced voltage to the input terminal 146.

In a case where a power is supplied to the vehicular lamp 10 and the semiconductor light emitting elements 32 emits light, the microcomputer 140 starts to count the pulse signals having a period based on the reference clock, upon receiving of the Zener voltage of the Zener diode 156 via the input terminal 146. Thus, the microcomputer 140 measures a time in which the light source array 30 emits light. In a case where no power is supplied to the vehicular lamp 10 and therefore the light source array 30 emits no light, the microcomputer 140 decreases the value counted during the period in which the light source array 30 was on, one by one, by the pulse signals having the period based on the reference clock. Thus, the microcomputer 140 can also measure a time in which the light source array 30 is off.

The microcomputer 140 also refers to the table stored therein to obtain a voltage based on the counted value increased/decreased in accordance with the on-time/off-time of the light source array 30, and then outputs the obtained voltage to the base terminal of the NPN transistor 104 via the analog voltage output terminal 144. The table stored in the microcomputer 140 is set in such a manner that a voltage to be applied to the NPN transistor 104 increases as the counted value increases. In this case, the current supplying unit 44 increases the supply current flowing through the light source array 30 in accordance with that voltage increase. Thus, the microcomputer 140 increases the supply current flowing through the light source array 30 with the time in which light source array 30 is on. Therefore, in this example, the vehicular lamp 10 can also suppress the change of the light amount of the semiconductor light emitting elements 32 caused by the temperature change of the semiconductor light emitting elements 32. The microcomputer 140 may output an analog voltage having the magnitude obtained by calculation based on the counted value, for example.

Moreover, in this example, the terminal 16 is connected directly to the power supply 500 without the lighting controlling unit 502. The microcomputer 140 receives the power from the power supply 5—via the terminal 16. Thus, even while the semiconductor light emitting elements 32 is off, the microcomputer 140 can receive the power. In addition, the microcomputer 140 can appropriately measure the time in which the semiconductor light emitting elements 32 is off. The terminal 16 may be connected to an ignition of an automobile, for example.

Figure 6:
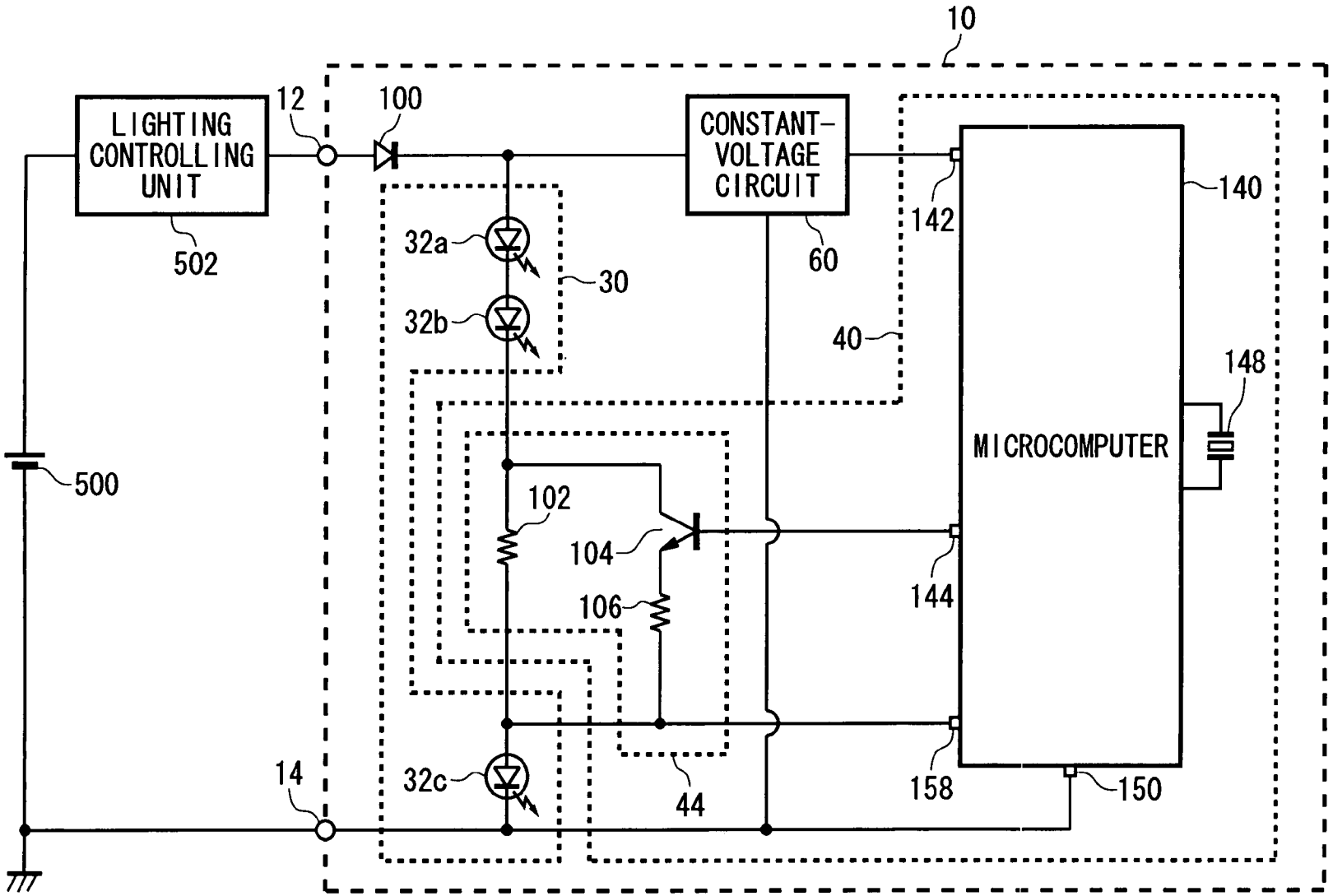
FIG. 6 illustrates still another exemplary structure of the vehicular lamp.

FIG. 6 illustrates still another exemplary structure of the vehicular lamp 10 of the present invention. The components in this example, that are the same as those in FIG. 5, are labeled with the same reference numerals as those in FIG. 5, and the description thereof is omitted except for the following. The vehicular lamp 10 includes the diode for protection against reverse connection 100, the light source array 30, the current controlling unit 40 and the constant-voltage circuit 60. The current controlling unit 40 includes the current supplying unit 44 and the microcomputer 140.

The light source array 30 in this example includes a plurality of semiconductor light emitting elements 32*a*, 32*b* and 32*c*. The semiconductor light emitting elements 32*a* and 32*b* connect in the upstream of the current supplying unit 44 in the current direction, while the semiconductor light emitting elements 32*c* connects to the downstream of the current supplying unit 44 in series with the resistor 102. The semiconductor light emitting elements 32*c* is provided in the downstream of the other semiconductor light emitting elements in the light source array 30 in the current direction. A cathode of the semiconductor light emitting elements 32*c* is grounded. The microcomputer 140 further includes an analog voltage input terminal 158 connected to an anode of the semiconductor light emitting elements 32*c* and measures a forward voltage of the semiconductor light emitting elements 32*c* based on a voltage at the anode of the semiconductor light emitting elements 32*c*. The microcomputer 140 also applies an analog voltage based on the measured forward voltage to the base terminal of the NPN transistor 104. The microcomputer 140 increases the analog voltage applied to the base terminal of the NPN transistor 104 in accordance with the drop in the measured forward voltage. The forward voltage drops with the temperature increase of the semiconductor light emitting elements 32. Thus, in this example, in a case where the temperature of the semiconductor light emitting elements 32 has changed, the vehicular lamp 10 can suppress the change of the light amount of the semiconductor light emitting elements 32.

For example, a case is considered where the supply current flowing through the semiconductor light emitting elements 32 was excessively increased when the forward voltage of the semiconductor light emitting elements 32 dropped. In this case, the temperature of the semiconductor light emitting elements 32 may further increase due to the excessive increase of the supply current so as to cause thermal runaway, for example. This may result in damage of the semiconductor light emitting elements 32. Thus, it is preferable that the microcomputer 140 supply the analog voltage equal to or lower than a predetermined upper limit to the base terminal of the NPN transistor 104. In this case, the damage of the semiconductor light emitting elements 32 can be prevented by limiting the upper limit of the supply current.

The microcomputer 140 may store a table in which forward voltages of the light source array 30 are made to correspond to voltages to be applied to the base terminal of the NPN transistor 104. The microcomputer 140 may output the analog voltage based on that table. Moreover, the microcomputer 140 may store a table set when the vehicular lamp 10 was fabricated, in accordance with variations of characteristics of the semiconductor light emitting elements 32. In this manner, the microcomputer 140 can suppress an effect of the variations of characteristics of the semiconductor light emitting elements 32.

Figure 7:
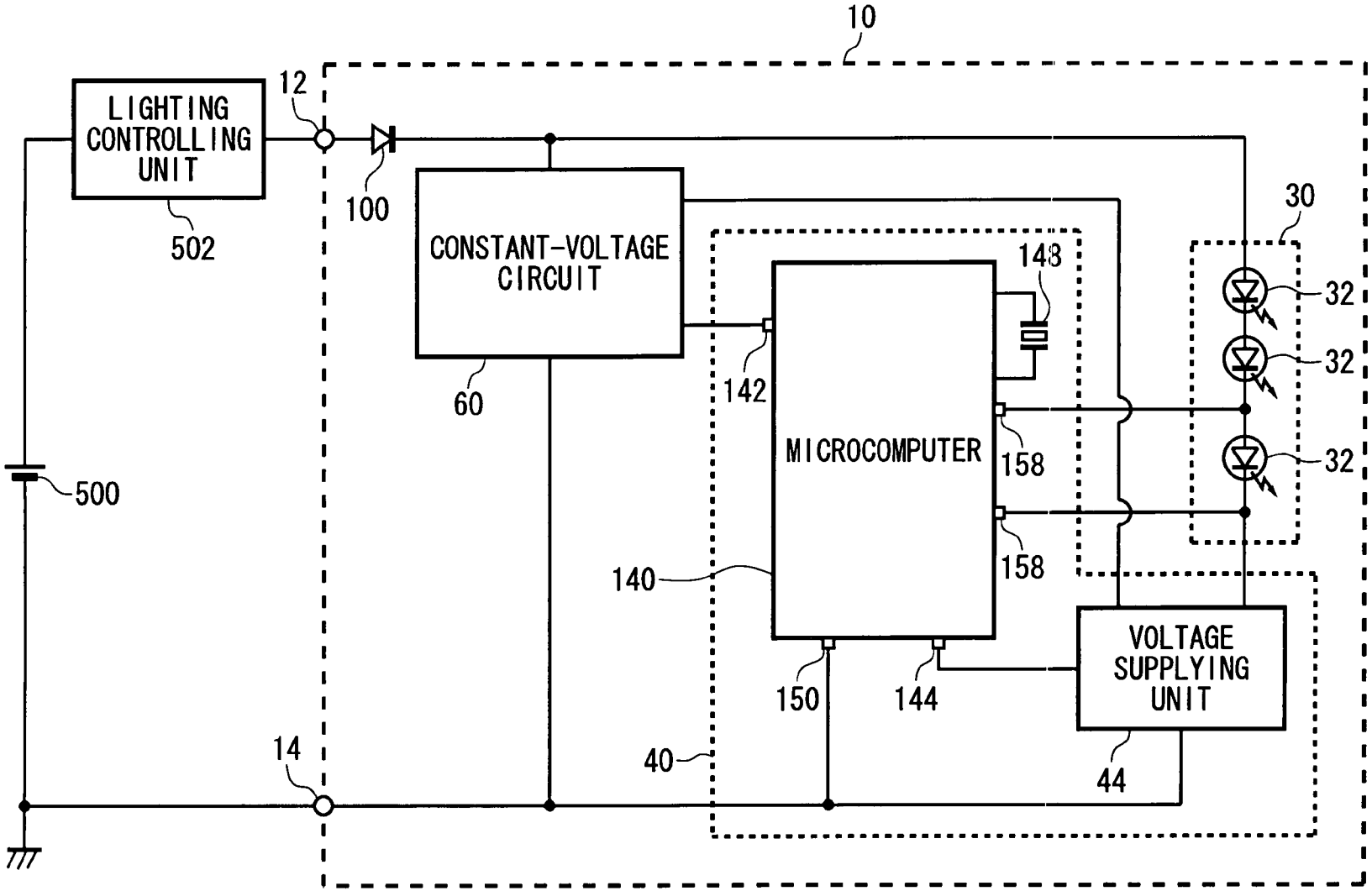
FIG. 7 illustrates still another exemplary structure of the vehicular lamp.

FIG. 7 illustrates still another exemplary structure of the vehicular lamp 10. The components in this example, that are the same as those in FIG. 2 or 6, are labeled with the same reference numerals, and the description thereof is omitted except for the following. The vehicular lamp 10 includes the diode for protection against reverse connection 100, the light source array 30, the current controlling unit 40 and the constant-voltage circuit 60. The current controlling unit 40 includes the current supplying unit 44 and the microcomputer 140.

The microcomputer 140 includes a plurality of analog voltage input terminals 158 that are connected to an anode and a cathode of one semiconductor light emitting elements 32, respectively. The microcomputer 140 receives an anode voltage and a cathode voltage of that semiconductor light emitting elements 32 from the analog voltage input terminals 158 and calculates the forward voltage of the semiconductor light emitting elements 32 from the difference between the anode and cathode voltages. The microcomputer 140 then refers to the table stored therein and applies a voltage based on the forward voltage of the semiconductor light emitting elements 32 to the current supplying unit 44 via the analog voltage output terminal 144. The microcomputer 140 increases the analog voltage applied to the current supplying unit 44 as the measured forward voltage drops. The current supplying unit 44 controls the supply current flowing through the light source array 30 based on the voltage applied thereto. In this example, the vehicular lamp 10 can also suppress the change of the light amount of the semiconductor light emitting elements 32 caused by the temperature change of the semiconductor light emitting elements 32.

Figure 8:
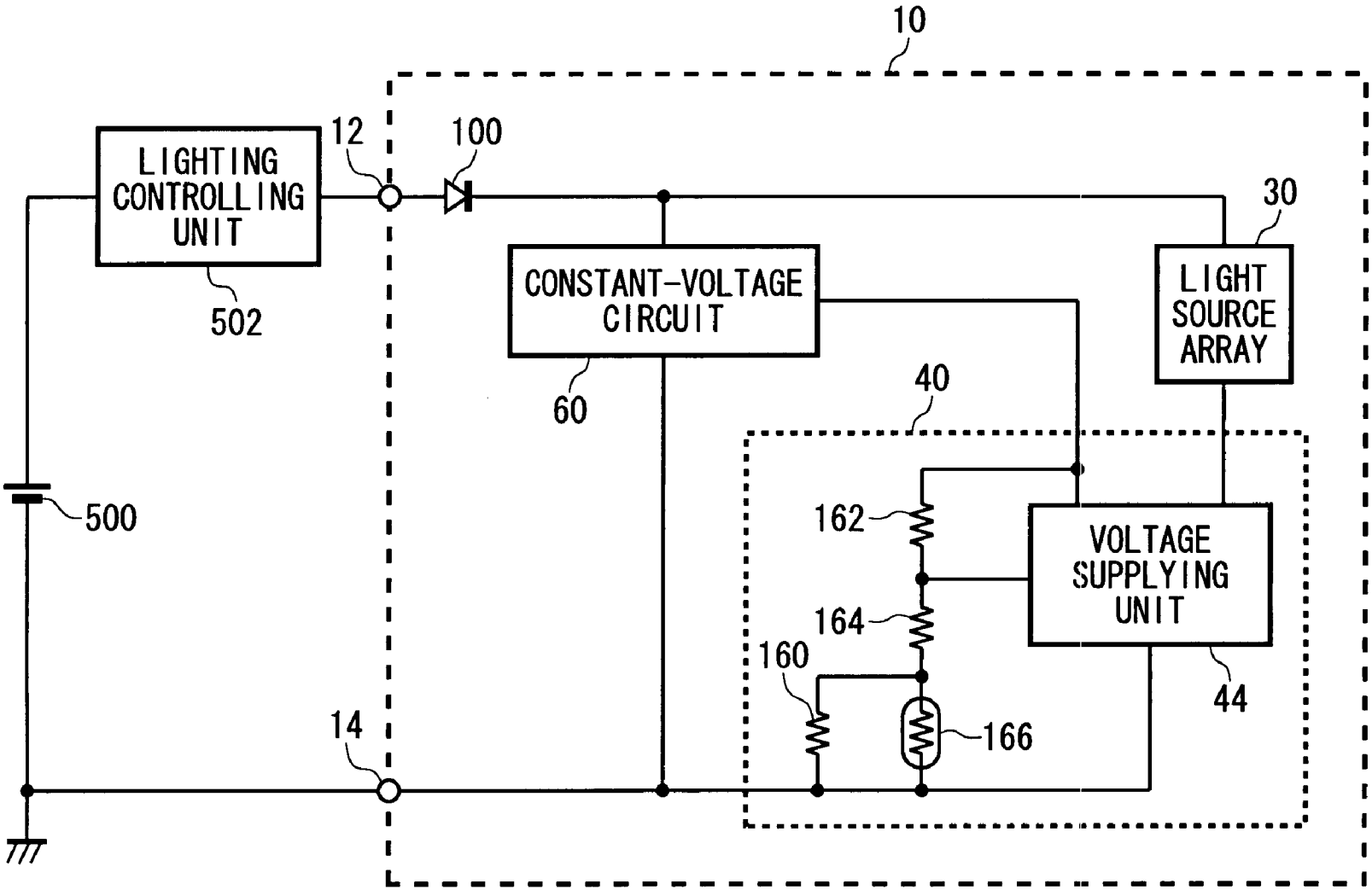
FIG. 8 illustrates still another exemplary structure of the vehicular lamp.

FIG. 8 illustrates still another exemplary structure of the vehicular lamp 10. The components in this example, that are the same as those in FIG. 2 or 5, are labeled with the same reference numerals as those in FIG. 2 or 5, and the description thereof is omitted except for points described below. The vehicular lamp 10 includes the diode for protection against reverse connection 100, the light source array 30, the current controlling unit 40 and the constant-voltage circuit 60.

The current controlling unit 40 includes the current supplying unit 44, a plurality of resistors 160-164 and a thermistor 166. The resistors 162 and 164 and the thermistor 166 are connected in series, divide a voltage received from the constant-voltage circuit 60, and then inputs the divided voltage to the current supplying unit 44 as the reference voltage. One end of the thermistor 166 is grounded, while the other end is grounded via the resistor 160. The thermistor 166 increases its electric resistance as the temperature increase. Moreover, the thermistor 166 applies a voltage at its upstream end in the current direction to the current supplying unit 44 via the resistor. Therefore, the current supplying unit 44 receives the reference voltage that increases with the temperature increase of the semiconductor light emitting elements 32. Thus, the current supplying unit 44 increases the supply current to be supplied to the light source array 30 as the reference voltage rises. Accordingly, the vehicular lamp 10 can also suppress the change of the light amount of the semiconductor light emitting elements 32 caused by the change in the temperature of the semiconductor light emitting elements 32.

It is preferable that a rate of change of the electric resistance of the thermistor 166 with respect to the change in the temperature be linear. It is also preferable that the resistors 160, 162 and 164 be arranged to allow a current that causes self-heating of the thermistor 166 to flow. Moreover, it is preferable to arrange the thermistor 166 in the vicinity of a land on a substrate, to which the semiconductor light emitting elements 32 is soldered so as to make the temperature change of the thermistor 166 substantially the same as the temperature change of the semiconductor light emitting elements 32. The thermistor 166 may be arranged in such a manner that a wiring on the substrate to which the semiconductor light emitting elements 32 is connected passes between the thermistor 166 and the substrate, for example. In this case, the thermistor 166 may detect the temperature of the semiconductor light emitting elements 32 via this wiring, for example. Alternatively, the thermistor 166 may be provided in the current supplying unit 44. In this case, the current supplying unit 44 may divide a voltage that depends on the supply current by using the thermistor 166 and may change the supply current flowing through the light source array 30 based on the divided voltage and the reference voltage that is constant.

Figure 9:
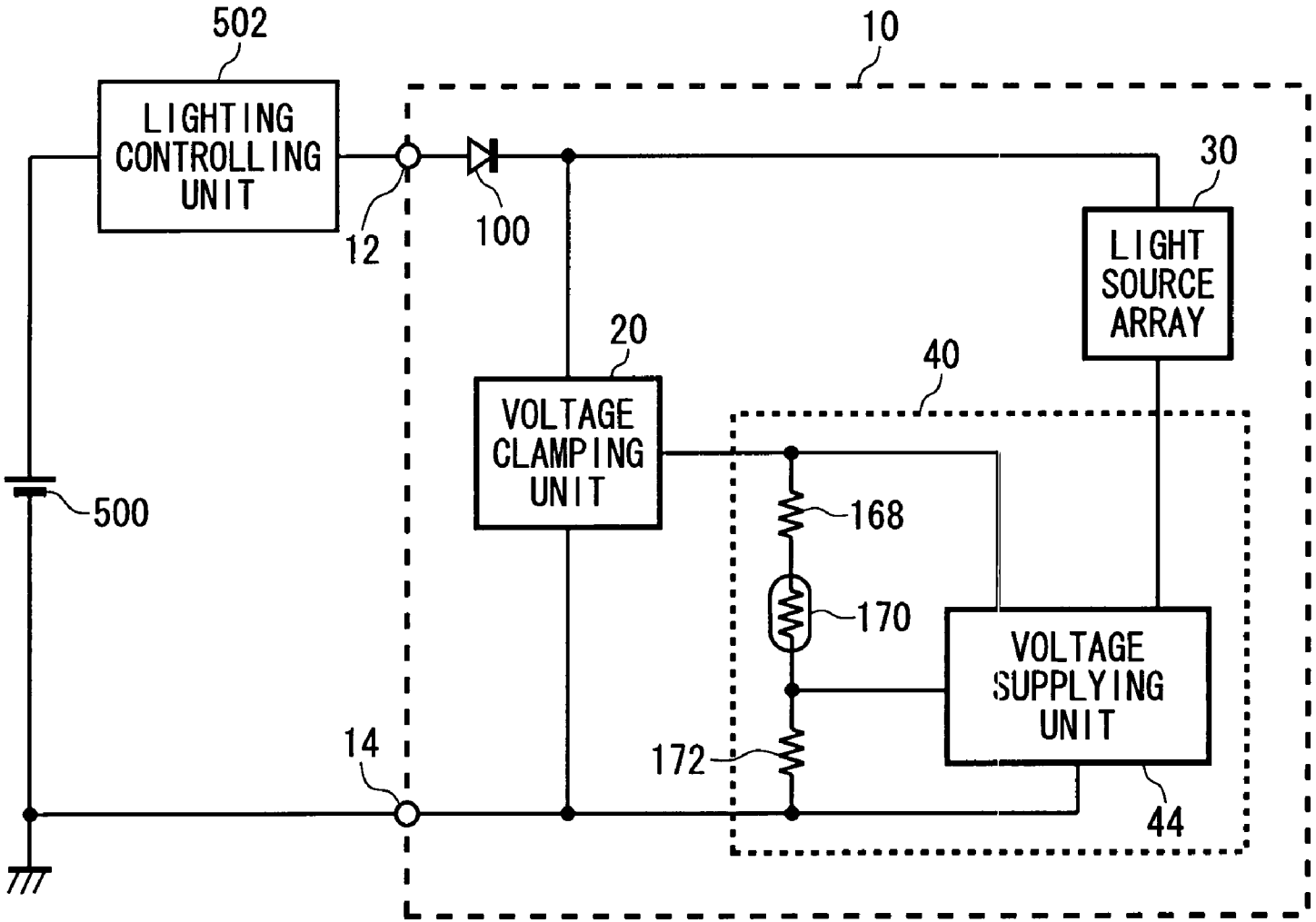
FIG. 9 illustrates still another exemplary structure of the vehicular lamp.

FIG. 9 illustrates still another exemplary structure of the vehicular lamp 10. The components in this example, that are the same as those in FIG. 1 or 8, are labeled with the same reference numerals as those in FIG. 1 or 8, and the description thereof is omitted except for the following. The vehicular lamp 10 includes the diode for protection against reverse connection 100, the voltage clamping unit 20, the light source array 30 and the current controlling unit 40.

In this example, the current controlling unit 40 includes the current supplying unit 44, a resistor 168, a thermistor 170 and a resistor 172. In this example, the thermistor 170 reduces its electric resistance with the temperature increase. One end of the thermistor 170 is grounded via the resistor 172, while the other end is connected to the voltage clamping unit 20 via the resistor 168. The current supplying unit 44 receives a voltage at the downstream end of the thermistor 166 in the current direction, as the reference voltage. The reference voltage the current supplying unit 44 receives in this case also increases with the temperature increase of the semiconductor light emitting elements 32. Moreover, the current supplying unit 44 increases the supply current to be supplied to the light source array 30 as the reference voltage rises. Thus, the vehicular lamp 10 in this example can also suppress the change of the light amount of the semiconductor light emitting elements 32 caused by the change in the temperature of the semiconductor light emitting elements 32.

Figure 10:
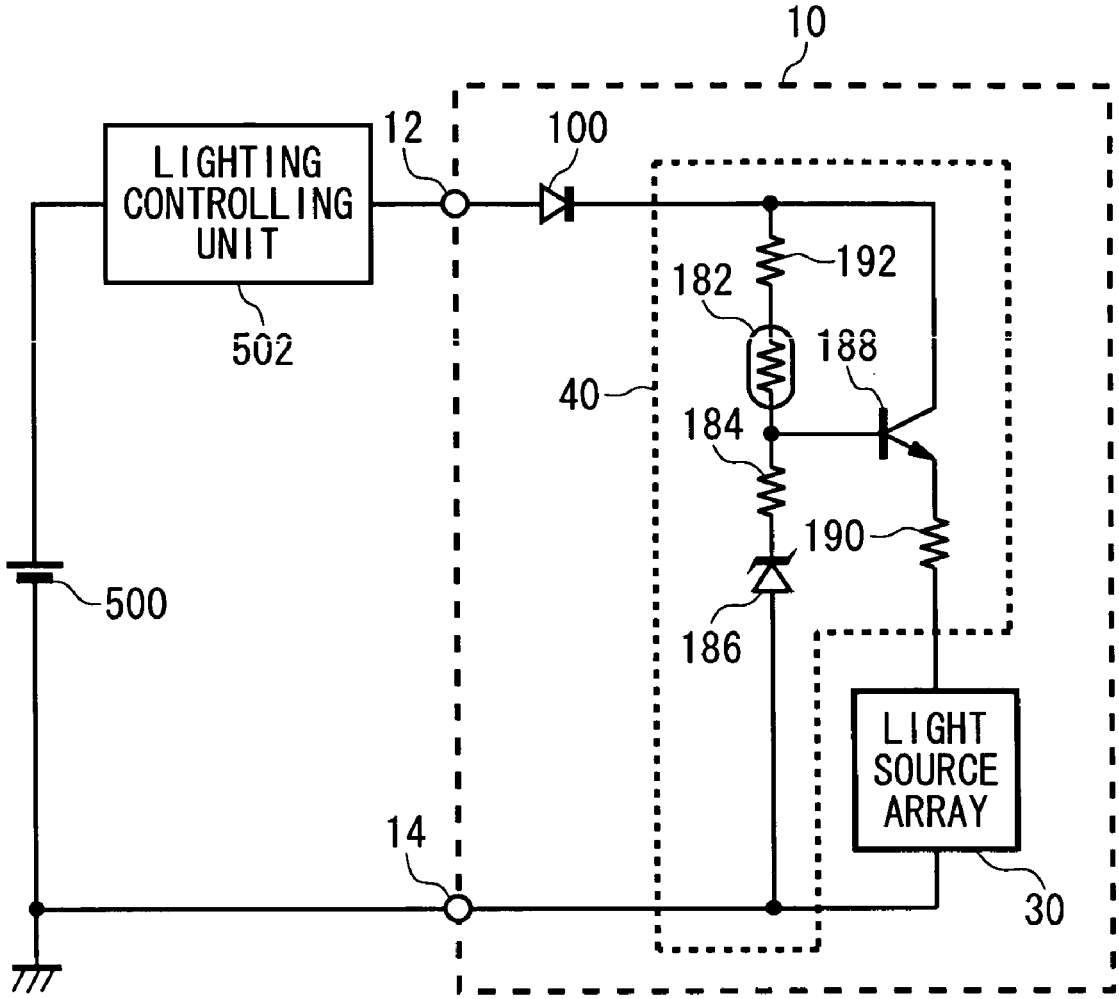
FIG. 10 illustrates still another exemplary structure of the vehicular lamp.

FIG. 10 illustrates still another exemplary structure of the vehicular lamp 10. The components in this example, that are the same as those in FIG. 8, are labeled with the same reference numerals as those in FIG. 8, and the description thereof is omitted except for the following. The vehicular lamp 10 includes the diode for protection against reverse connection 100, the light source array 30 and the current controlling unit 40. The downstream end of the light source array 30 in the current direction is grounded, while the upstream end is connected to the current controlling unit 40.

The current controlling unit 40 includes resistors 184, 190 and 192, a thermistor 182, a Zener diode 186 and an NPN transistor 188. The thermistor 182 of this example reduces its electric resistance as the temperature increases. One end of the thermistor 182 is connected to the terminal 12 via the resistor 192 and the diode 100, while the other end is connected to a cathode of the Zener diode 186 via the resistor 184. The other end of the thermistor 182 is also connected to a base terminal of the NPN transistor 188. An anode of the Zener diode 186 is grounded. A collector terminal of the NPN transistor 188 is connected to the terminal 12 via the diode 100, while an emitter terminal is connected to the upstream end of the light source array 30 in the current direction via the resistor 190. It is preferable that the thermistor 182 be arranged in the vicinity of each semiconductor light emitting elements 32 so as to have the temperature that is substantially the same as the temperature of each semiconductor light emitting elements 32.

When a power is supplied to the vehicular lamp 10, a voltage divided by the resistor 192, the thermistor 182, the resistor 184 and the Zener diode 186 is applied to the base terminal of the NPN transistor 188 which in turn causes the supply current to flow through the resistor 190 and the light source array 30 in accordance with the voltage applied to its base terminal, thereby turning the semiconductor light emitting elements 32 on. As the temperature of the semiconductor light emitting elements 32 that is on has increased, the electric resistance of the thermistor 182 is reduced.

In this case, since the base voltage of the NPN transistor 188 rises, the NPN transistor 188 increases the supply current flowing through the light source array 30. Therefore, in this example, the vehicular lamp 10 can also prevent the decrease of the light amount of the semiconductor light emitting elements 32 caused by the temperature increase of the semiconductor light emitting elements 32.

When no power is supplied to the vehicular lamp 10, the semiconductor light emitting elements 32 is off and the temperature thereof decreases. Thus, the electric resistance of the thermistor 182 increases. Therefore, in a case where the vehicular lamp 10 is turned on after it was turned off, the current controlling unit 40 reduces the supply current flowing through the light source 30. Accordingly, in this embodiment, the vehicular lamp 10 can also suppress the change of the light amount of the semiconductor light emitting elements 32 caused by the temperature change.

Figure 11:
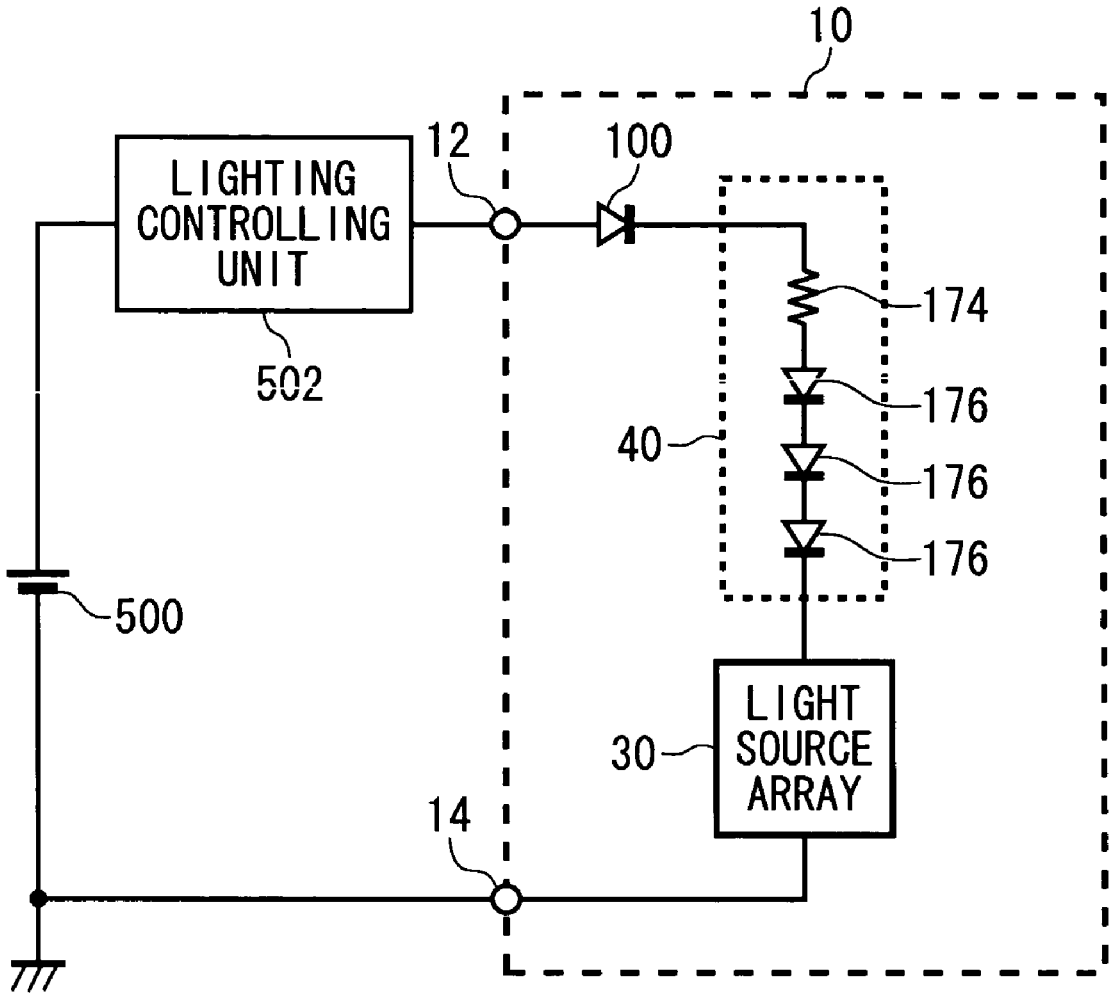
FIG. 11 illustrates still another exemplary structure of the vehicular lamp.

FIG. 11 illustrates still another exemplary structure of the vehicular lamp 10. The components in this example, that are the same as those in FIG. 1, are labeled with the same reference numerals as those in FIG. 1, and the description thereof is omitted except for the following. The vehicular lamp 10 includes the diode for protection against reverse connection 100, the light source array 30 and the current controlling unit 40. The downstream end of the light source array 30 in the current direction is grounded, while the upstream end is connected to the downstream end of the current controlling unit 40 in the current direction.

The current controlling unit 40 includes a resistor 174 and a plurality of diodes 176. Those diodes 176 are connected between the diode for protection against reverse connection 100 and the light source array 30 in forward direction in series. It is preferable that the diodes 176 be arranged in the vicinity of the semiconductor light emitting elements 32, respectively, in such a manner that each temperature change of that diode 176 is substantially the same as the temperature change of the corresponding at semiconductor light emitting elements 32.

When a power is supplied to the vehicular lamp 10, the semiconductor light emitting elements 32 are turned on. Then, as the temperatures of the semiconductor light emitting elements 32 increase, the temperatures of the diodes 176 respectively arranged in the vicinity of the semiconductor light emitting elements 32 also increase. In this case, the forward voltages of the semiconductor light emitting elements 32 and the diodes 176 respectively arranged in the vicinity of the semiconductor light emitting elements 32 drop. Thus, a voltage across the resistor 174 rises and the current flowing through the semiconductor light emitting elements 32 also increases. Therefore, in this example, the vehicular lamp 10 canal so prevent the decrease of the light amount of the semiconductor light emitting elements 32 caused by the temperature increase of the semiconductor light emitting elements 32.

When no power is supplied to the vehicular lamp 10, the semiconductor light emitting elements 32 are off and the temperature thereof decreases. Moreover, with the temperature decrease of the semiconductor light emitting elements 32, the forward direction voltages of the semiconductor light emitting elements 32 and the diodes 176 rise. Thus, in a case where the vehicular lamp has received a power after the temperature fell, the current supplying unit 40 reduces the supply current. In this manner, the vehicular lamp 10 in this example can also suppress the change of the light amount of the semiconductor light emitting elements 32 caused by the temperature change of the semiconductor light emitting elements 32. Please note that the diode 176 may further have a function of a diode for protection against reverse connection.

Figure 12:
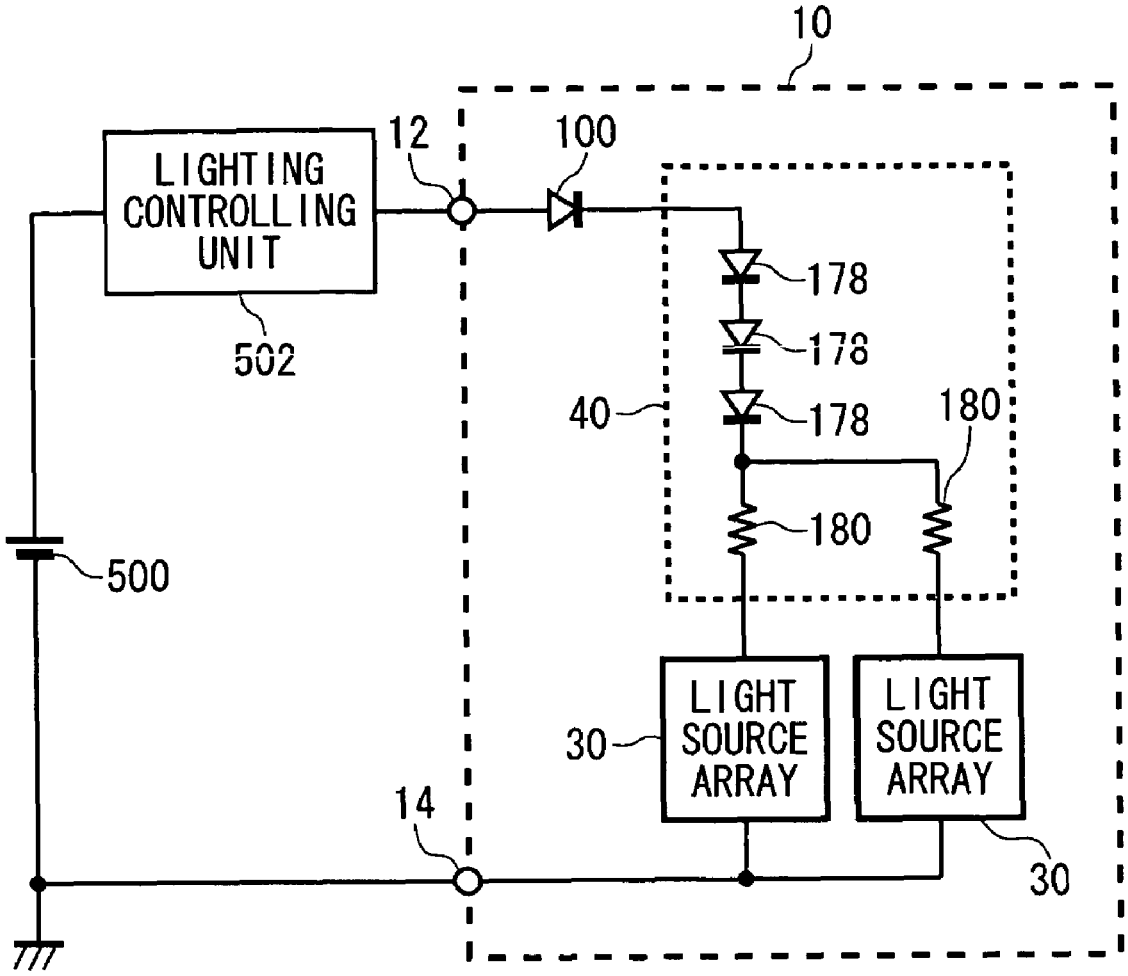
FIG. 12 illustrates still another exemplary structure of the vehicular lamp.

FIG. 12 illustrates still another exemplary structure of the vehicular lamp 10. The components in this example, that are the same as those in FIG. 11, are labeled with the same reference numerals as those in FIG. 11, and the description thereof is omitted, except for the following. The vehicular lamp 10 includes the diode for protection against reverse connection 100, the current controlling unit 40 and a plurality of light source arrays 30. The downstream ends of the light source arrays 30 in the current direction are grounded, respectively, while the upstream ends are connected to the downstream end of the current controlling unit 40 in the current direction.

The current controlling unit 40 includes a plurality of diodes 178, and a plurality of resistors 180 respectively corresponding to the light source arrays 30. The diodes 178 are connected in forward direction in series between the diode 100 and the resistors 180. It is preferable that each diode 178 be arranged in the corresponding semiconductor light emitting elements 32 to have a temperature that is substantially the same as the corresponding semiconductor light emitting elements 32. Although a plurality of diodes 178 connected in series in forward direction are provided commonly to a plurality of light source arrays 30, they may be provided to correspond to the light source arrays 30, respectively. In this example, the forward voltage of each diode 178 drops as the temperature of the semiconductor light emitting elements 32 increases, and therefore the supply current flowing through the respective light source array 30 increases. Thus, the vehicular lamp 10 of this example can suppress the change of the light amount of the semiconductor light emitting elements 32 caused by the temperature change of the semiconductor light emitting elements 32.

Figure 13:
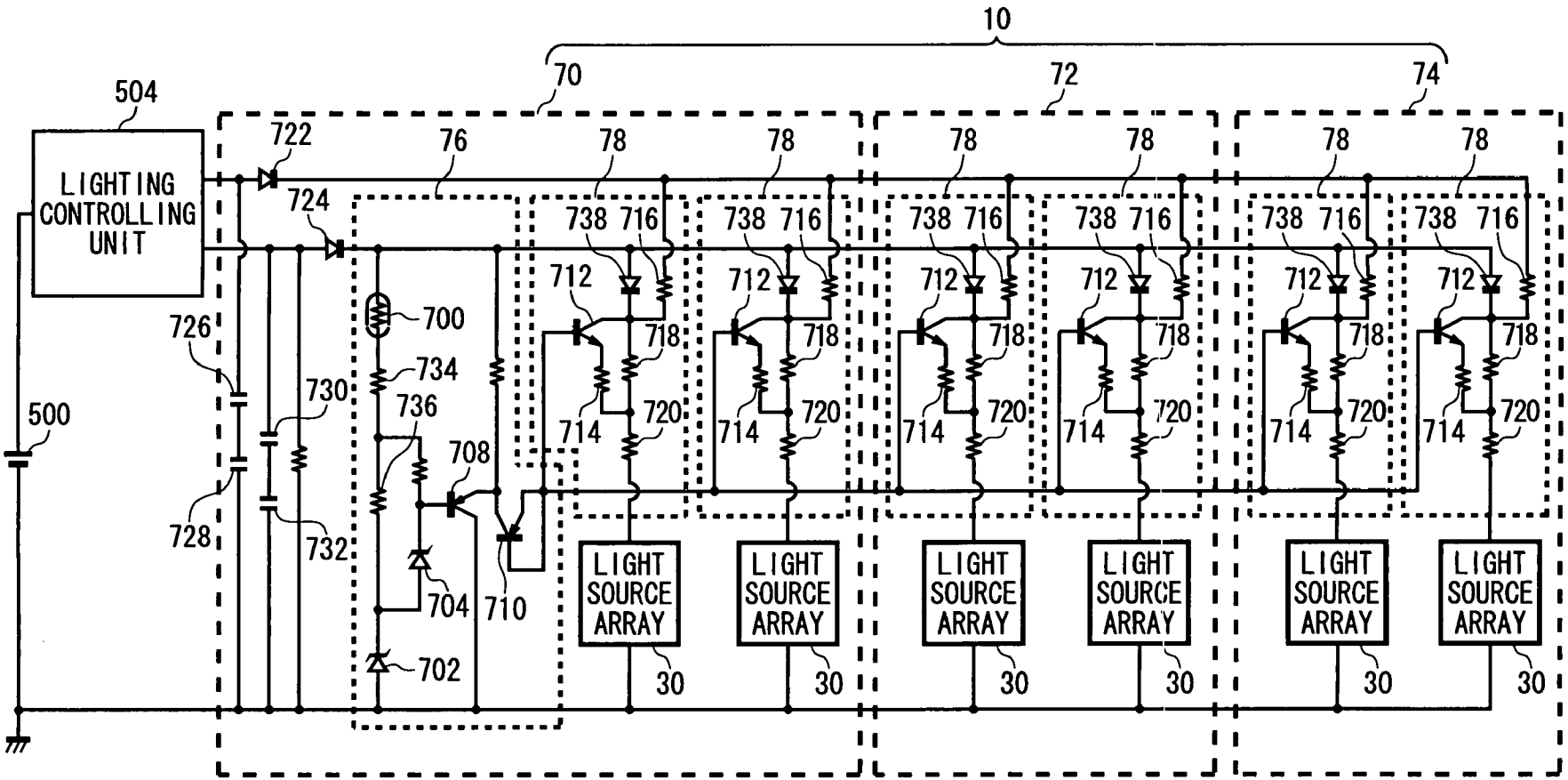
FIG. 13 illustrates still another exemplary structure of the vehicular lamp.

FIG. 13 illustrates still another exemplary structure of the vehicular lamp 10. The components in this example, that are the same as those in FIG. 1, are labeled with the same reference numerals as those in FIG. 1, and the description there of is omitted, except for the following.

The vehicular lamp 10 includes a plurality of substrates 70-74 each of which is provided with a plurality of light source arrays 30 and lighting circuits for turning the light source arrays 30 on, respectively. The substrate 70 includes a current specifying unit 76, a plurality of light source arrays 30, a plurality of current supplying units 78 corresponding to the light source arrays 30, respectively, diodes for protection against reverse connection 722 and 724, capacitors 726, 728, 730 and 732 and a resistor.

In this example, in a case where the vehicular lamp 10 is turned on as a tail lamp, the lighting controlling unit 504 supplies a power to the vehicular lamp 10 via the diode for protection against reverse connection 722. In a case where the vehicular lamp 10 is turned on as a stop lamp, the lighting controlling unit 504 supplies the power to the vehicular lamp 10 via the diode for protection against reverse connection 724.

The current specifying unit 76 includes a thermistor 700, Zener diodes 702 and 704, PNP transistors 708 and 710 and a plurality of resistors. The thermistor 700, a plurality of resistors 734 and 736, and the Zener diode 702 are connected in series, and, in the case where the vehicular lamp 10 is turned on as the stop lamp, divides a positive voltage output from the lighting controlling unit 504 and supplies the divided voltage to a base terminal of the PNP transistor 708.

In this example, electric resistance of the thermistor 700 decreases with the temperature increase. Thus, the PNP transistor 708 receives a voltage that rises with the temperature increase, at its base terminal. The PNP transistor 708 also supplies that voltage received at its base terminal to the current supplying unit 78 via the transistor 710. In this manner, the current specifying unit 76 supplies the voltage that rises with the temperature increase to the current supplying unit 78.

The PNP transistor 710 is connected to an emitter terminal of the PNP transistor 708 in diode-connection. Thus, the PNP transistor 710 protects the current supplying unit 78 against the dump surge. Moreover, the PNP transistor 710 cancels an emitter-base voltage of the PNP transistor 708, thereby supplying a voltage substantially equal to the base voltage of the PNP transistor 708 to the current supplying unit 78.

The Zener diode 702 grounds a downstream end of the resistor 736, thereby limiting the upper limit of the base terminal of the PNP transistor 708. Thus, the Zener diode 702 prevents an excess supply current from flowing through the light source array 30 in a case where the voltage input via the lighting controlling unit 504 has changed. Moreover, the Zener diode 704 connects the base terminal of the PNP transistor 708 and the Zener diode 702 to each other. Thus, in a case where the temperature of the light source array 30 has increased and the electric resistance of the thermistor 700 has been reduced, the base voltage of the PNP transistor 708 can be prevented from rising excessively. The capacitors 726, 728, 730 and 732 protect the vehicular lamp 10 against static shock.

The current supplying unit 78 includes a plurality of resistors 714-720, an NPN transistor 712 and a diode 738. In a case where the vehicular lamp 10 is turned on as a tail lamp, the current supplying unit 78 supplies a current depending on the positive voltage received from the lighting controlling unit 504 via the diode 722, to the light source array 30 via a plurality of resistors 716, 718 and 720.

On the other hand, in a case where the vehicular lamp 10 is turned on as a stop lamp, the current supplying unit 78 supplies a current depending on a positive voltage received from the lighting controlling unit 504 via the diode 724, to the light source array 30. In this case, a plurality of resistors 718 and 720 supply a substantially constant current that depends on that positive voltage to the light source array 30. Moreover, the NPN transistor 712 supplies a current that depends on a voltage received at its base terminal from the current specifying unit 76, to the light source array 30 via a plurality of resistors 712 and 720. In this case, the NPN transistor 712 increases the current to be supplied to the light source array 30 in accordance with the increase of the voltage received from the current specifying unit 76.

The current specifying unit 76 supplies a voltage to the NPN transistor 712, that rises as the temperature rises. Thus, the NPN transistor 712 supplies the current that increases with the temperature increase to the light source array 30. Therefore, the vehicular lamp 10 of this example can also suppress the change of the light amount of the semiconductor light emitting elements 32 caused by the temperature change of the semiconductor light emitting elements 32.

Each of the substrates 72 and 74 includes a plurality of light source arrays 30 and a plurality of current supplying units 78 corresponding to those light source arrays 30, respectively. Each of the substrates 72 and 74 receives a power from the lighting controlling unit 504 via the substrate 70. The current supplying unit 78 in each of the substrates 72 and 74 is controlled by the current specifying unit 76 in the substrate 70. Thus, the change of the light amount of the semiconductor light emitting elements 32 can be suppressed also in each of the substrates 72 and 74.

As is apparent from the above description, according to the present invention, the vehicular lamp 10 can suppress the change of the light amount of the semiconductor light emitting elements 32 caused by the change in the temperature of the semiconductor light emitting elements 32.

Although the present invention has been described by way of exemplary embodiments, it should be understood that those skilled in the art might make many changes and substitutions without departing from the spirit and the scope of the present invention which is defined only by the appended claims.

What is claimed is:

1. A vehicular lamp used in an automobile, comprising:

semiconductor light emitting elements operable to emit light;

a time measurement unit operable to measure time in which said semiconductor light emitting elements continues to emit light and measure time in which said semiconductor light emitting elements continue to emit no light; and a current supplying unit operable to supply a supply to said semiconductor light emitting elements current that increases as the light emitting time measured by said time measurement unit increases, wherein the current supplying unit is operable to supply to said semiconductor light emitting elements a supply current that decreases as the light non-emitting time measured by said time measurement unit increases, when said semiconductor light emitting elements are turned on after said semiconductor light emitting elements were turned off.

2. A vehicular lamp used in an automobile, comprising:

semiconductor light emitting elements operable to emit light;

a time measurement unit operable to measure time in which said semiconductor light emitting elements continues to emit light; and a current supplying unit operable to supply to said semiconductor light emitting elements a supply current that increases as the time measured by said time measurement unit increases, wherein said time measurement unit includes a capacitor that is charged with a time constant substantially equal to a time constant of increase in a temperature of said semiconductor light emitting elements in a case where said semiconductor light emitting elements emits light, and said current supplying unit outputs said supply current that increases as the time measured by said time measurement unit increases by outputting said supply current that increases as a charged voltage of said capacitor rises.

3. A vehicular lamp as claimed in claim 2, wherein said capacitor is discharged with a time constant substantially equal to a time constant of decrease in said temperature of said semiconductor light emitting elements in a case where said semiconductor light emitting elements emits no light, and said current supplying unit outputs said supply current that decreases as said charged voltages drops.

4. A vehicular lamp as claimed in claim 3, further comprising a voltage limiting unit operable to limit said charged voltage to have a predetermined upper limit that is lower than a power-supply voltage externally supplied to said vehicular lamp, to make the time constant of the temperature increase of said semiconductor light emitting elements substantially equal to the time constant of charging of said capacitor in a case where said semiconductor light emitting elements emits light.

5. A vehicular lamp used in an automobile, comprising:

semiconductor light emitting elements operable to emit light;

a time measurement unit operable to measure time in which said semiconductor light emitting elements continues to emit light; and a current supplying unit operable to supply to said semiconductor light emitting elements a supply current that increases as the time measured by said time measurement unit increases, wherein said time measurement unit includes a counter operable to count pulse signals having a predetermined period in a case where said semiconductor light emitting elements emits light and to decrease a counted value one by one based on said pulse signals in a case where said semiconductor light emitting elements emits no light, and said current supplying unit outputs said supply current based on said counted value of said counter.

* * * * *